United States Patent [19]

Stenius

[11] Patent Number: 4,596,400

[45] Date of Patent: Jun. 24, 1986

[54] NON-SLIPPING DEVICE FOR SKIS

[76] Inventor: Per A. Stenius, PB 104, SF-00121 Helsingfors, Finland

[21] Appl. No.: 619,840

[22] Filed: Jun. 12, 1984

Related U.S. Application Data

[63] Continuation-in-part of Ser. No. 324,021, Nov. 21, 1981.

[30] Foreign Application Priority Data

Jun. 21, 1983 [FI] Finland ..... 832260

[51] Int. Cl.[4] ..... A63C 7/10

[52] U.S. Cl. ..... 280/605

[58] Field of Search ..... 280/604, 605; 24/643, 24/644, 649

[56] References Cited

U.S. PATENT DOCUMENTS

| | | | |
|---|---|---|---|
| 1,156,174 | 10/1915 | Rall | 280/605 |
| 1,345,988 | 7/1920 | Brager et al. | 280/605 |
| 2,358,213 | 9/1944 | Courage | 280/604 |
| 3,741,575 | 6/1973 | Bortoli | 280/605 |
| 3,785,663 | 1/1974 | Spieldiener et al. | 280/605 |
| 4,018,455 | 4/1977 | Bieler | 280/605 |
| 4,239,255 | 12/1980 | Boudreau | 280/605 |

FOREIGN PATENT DOCUMENTS

| | | | |
|---|---|---|---|
| 38591 | 8/1909 | Austria | 280/605 |
| 135368 | 11/1933 | Austria | 280/605 |
| 145541 | 12/1935 | Austria | 280/605 |
| 146514 | 3/1936 | Austria | 280/605 |
| 803282 | 4/1951 | Fed. Rep. of Germany | 280/605 |
| 2539974 | 3/1977 | Fed. Rep. of Germany | 280/605 |
| 2805092 | 8/1979 | Fed. Rep. of Germany | 280/605 |
| 69128 | 4/1945 | Norway | 280/605 |
| 50439 | 2/1919 | Sweden | 280/605 |
| 165186 | 1/1934 | Switzerland | 280/605 |
| 212222 | 2/1941 | Switzerland | 280/604 |
| 217794 | 2/1942 | Switzerland | 280/605 |
| 234601 | 2/1945 | Switzerland | 280/605 |
| 336738 | 4/1959 | Switzerland | 280/605 |
| 450984 | 5/1968 | Switzerland | 280/605 |
| 586053 | 3/1977 | Switzerland | 280/605 |

*Primary Examiner*—John J. Love
*Assistant Examiner*—Eric Culbreth
*Attorney, Agent, or Firm*—Merchant, Gould, Smith, Edell, Welter, & Schmidt

[57] ABSTRACT

An improved non-slipping device for skis is described having a braking blade turning under the bottom of the ski. The braking element is easily slid into slots in fastening elements on the side of the ski and removably kept in position by a locking device. Springs are provided to bias the blade to effect braking at the backward motion of the ski.

8 Claims, 8 Drawing Figures

NON-SLIPPING DEVICE FOR SKIS

CROSS-REFERENCE TO RELATED APPLICATIONS

This application is a continuation-in-part of U.S. application Ser. No. 324,021 filed on Nov. 21, 1981 and titled "Non-slipping device for skis".

BACKGROUND OF THE INVENTION

1. Field of the Invention

The present invention is directed to an improved non-slipping device adapted to prevent the back-sliding of skis and removably mounted onto a ski. Said non-slipping device contains a removable braking element fitted into fastening elements attachable to the ski, said braking element including a blade extending under the bottom surface of the ski. The braking element is kept in place with the aid of locking means movably arranged relative to said fastening elements whereby the upturned sides of said braking element include short pivot pins directed towards each other and adapted to co-act with said fastening elements, said braking element in its attached position being biased by a spring in such a way that said blade in its braking position extends about perpendicularly downwards from the bottom surface of said ski and in its forward running position butts against said bottom surface.

2. Description of the Prior Art

It is a frequently occurring problem in cross-country skiing that the skis glide equally well backwards as forward. This problem is especially noticeable with modern skis which have the bottoms made of well gliding synthetic material which normally need not be waxed at all.

The bottom surface of modern ski may include recesses and notches which are supposed to improve the gripping ability of the skis, but the value of which has been found to be limited.

Another possibility for improving the gripping ability is to use purely mechanical means. Various devices which press into the snow have been used. Such devices may consist of spike-shaped parts pressing straight downwards, similar to the safety brakes which prevent the free gliding of slalom skis, or they may have pivotally turning blade members which are biased into a downward direction by spring elements and which at the forward running motion of the skis swing to a direction essentially parallel with the bottom of the ski in order to allow for good forward glide.

The above mentioned spike-shaped non-slipping devices are generally complicated in structure. On hard snow such devices may work satisfactorily, but since such devices are often susceptible to impacts and moreover are easily filled with snow their utility is very restricted.

The kind of non-slipping devices having swinging braking elements generally include some kind of blades which are swung down at the sides of the skis. Such non-slipping devices are often mounted in such a way that they fairly easily may be removed when the condition allow. This kind of devices are described e.g. in CH Pat. No. 586 053 (Schwarz) and in SE Pat. No. 50 439 (Dahl). The greatest disadvantage with non-slipping devices which are mounted on, or which function on the sides of the skis is that in their effective position they extend fairly far out from the sides of the skis. From this reason they can seldom be used in good narrow tracks.

The mechanical parts extending outside the skis form a risk of danger, since they may easily catch in the corresponding device on the other ski, in the snow, or in any obstacles at the side of the track. This is especially dangerous when skiing in slopes at high speed. The same disadvantages are connected with the use of non-slipping devices where the connnection of the braking blade is realized using rather bulky fastening elements mounted on top of the ski like the device shown in CH Pat. No. 165 186 (Moser) or extending from the top widely over the sides of the ski as shown in U.S. Pat. No. 2,375,943 (Pape), which elements are fixed to the ski even when the braking element is removed from its working position.

Earlier known non-slipping devices of the type having a blade element pivotally attached to a horizontal axis and extending under the bottom surface of the ski may include an axle system lying either above the upper plane of the skis as is shown in DE Pat. No. 803 282 (Prestel) and CH Pat. No. 165 186 (Moser) or in the sides of the skis as is the case according to CH Pat. No. 336 738 (Chatelain). The solutions according to the above mentioned patents all include such a positioning of the fastening elements that the pivot pins or other contraptions extend outside the sides or the top of the skis. Such a positioning of the axis forms a risk of danger as mentioned previously. Furthermore a positioning of the axis above the top surface of the ski will cause the braking edge of the braking element to move a long way from the position when the ski is running forwards to the braking position. This long movement will make the action of the brake arrangement slow and will bring the braking edge to a position far below the running surface of the ski, which is a great disadvantage on semi-hard surfaces.

A solution with specially designed pivot pins screwable into separate elements such as one of the embodiments shown in DE Pat. No. 803 282 (Prestel) can hardly be used in the conditions generally prevailing at skiing when it is cold, and snow and ice penetrate into the holes and makes it impossible to attach the blade in a simple way. On the other hand complicated fastening methods are impractical in daily use. From the practical point of view it is generally necessary that a blade which is adapted to glide under the running surface of the ski is fastened in such a way that it may easily be removed at need without there existing any risk of the blade falling off by mistake.

Large forces are exerted on the pivot pins during the function of the non-slipping device and it seams unlikely that a fixed pivot which is merely mounted onto a bore in the side of the ski will be kept in place for any longer space of time, especially since such outward extending pivots easily clash against each other at skiing. Moreover a pivot screwed into the side of the ski may weaken the ski considerably. In the construction described in CH Pat. No. 336 738 (Chatelain) the pivot should be attached to the ski already at the production stage, which presumably is one reason as to why the device has not become generally used.

In the prior known non-slipping device solutions having a blade moving under the surface of the ski, the blade is usually stopped in its braking position by the blade edge resting against the bottom surface of the ski. With time such a construction will impair the bottom surface of the ski in the place where the blade edges touches the same, and may even lead to an eventual breaking of the ski.

SUMMARY OF THE INVENTION

In order to rectify the deficiencies which have been associated with the prior known non-slipping devices the improved non-slipping device according to the invention has been developed. The improved non-slipping device according to the invention includes (a) a fastening element attachable to the ski and extending at least down the sides of the ski and having on each of said sides a slot therein located below the top surface of the ski;

(b) a removable pivoting braking element including a braking blade under the bottom of the ski and a pair of side pieces extending on either side of the ski generally parallel to each other and orthogonal to said braking blade, each of said side pieces including a short pivot pin fixed thereto, said pivot pins extending towards each other and having a relative distance adjusted to about the width of the ski and sized to fit snugly into the bottom of said slots in said fastening element for pivotally connecting said braking element to said fastening element;

(c) spring means attached to said ski applying a rotational force upon said side pieces of said braking element to cause said blade to be biased downwards substantially perpendicularly to the forward travel of the ski; and (d) locking means attached to said fastening element for locking said pivot pins in bottom of said slot to said fastening element, and eac of said locking means including a side thereof sized to form together with said slots in said fastening element retaining bearings for said pivot pins.

The device is construed in such a way that it can be used on most of the available standard skis. The fastening elements are suitably attached to the ski with screws so that the device does not load the ski any more than a normal ski binding would do. The most suitable location of the a non-slipping device is close to the binding. For increased effect under special circumstances several devices can be mounted in succession. Due to the special character of the construction of the device according to the invention the non-slipping device does not normally add to the width of the ski any more than the binding. The fastening elements are preferably beveled in their edges and do not extend far outside the side or the top surfaces of the ski. The fastening elements may also be provided with special removable or movable covers to prevent snow from penetrating into the separate parts when the device for some reason is removed for longer periods. In actual practice the blade is formed in such a way that it is in general unnecessary to remove the blade even when it is not needed.

The non-slipping device according to the invention has the pivot axis of the blade at a relatively low position relative to the bottom surface of the ski and any case below the upper surface of the ski. The pivot axis is preferably positioned about in the middle of the side of the ski. This location of the pivot axis is made possible bu the special fastening elements of the invention and results in that the arc of movement of the edge of the blade is short and quick and will function well even on hard ground.

The fastening elements of the invention are preferably made as separate parts in order to facilitate adaption to skis of different width. For skis of standard dimensions the fastening elements may be made in one piece for simpler production and fastening.

BRIEF DESCRIPTION OF THE DRAWINGS

The invention will now be described with reference to the accompanying drawings.

DETAILED DESCRIPTION OF THE INVENTION

While the present invention will be described herein fully by reference to the preferred embodiment it is not the intention to thereby limit the invention to that embodiment. On the contrary it is the intent to cover all alternatives, modifications and equivalents within the spirit and scope of the invention.

Figure 1:
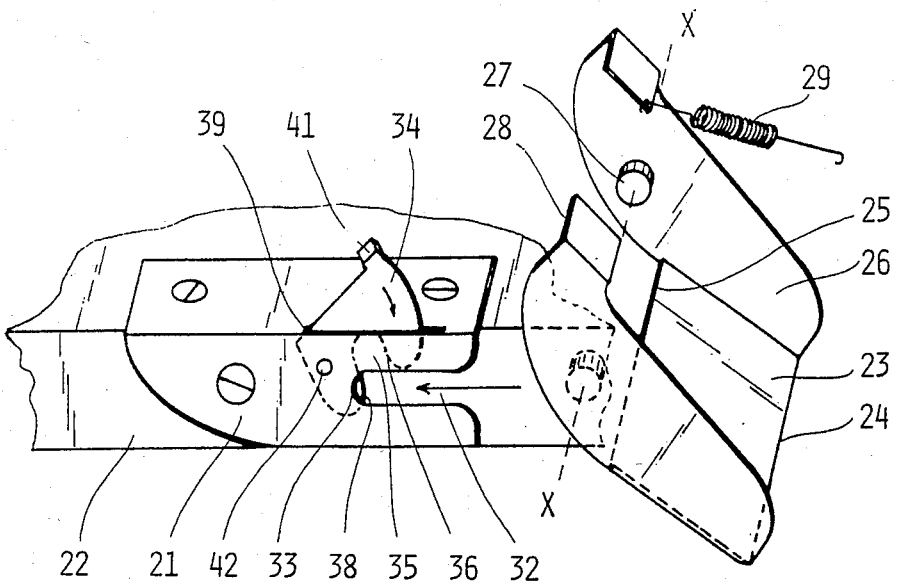
FIG. 1 is a perspective view of an embodiment of the invention showing only one of the fastening elements and part of the ski with the blade being inserted into the fastening elements.

Turning now to the drawings, FIG. 1 shows a braking element being inserted onto a ski. It is evident that in practice a similar brake arrangement is arranged on the other ski also. For clarity only one of the two fastening elements 21 is shown attached to the ski 22 (only partly outlined).

Figure 2:
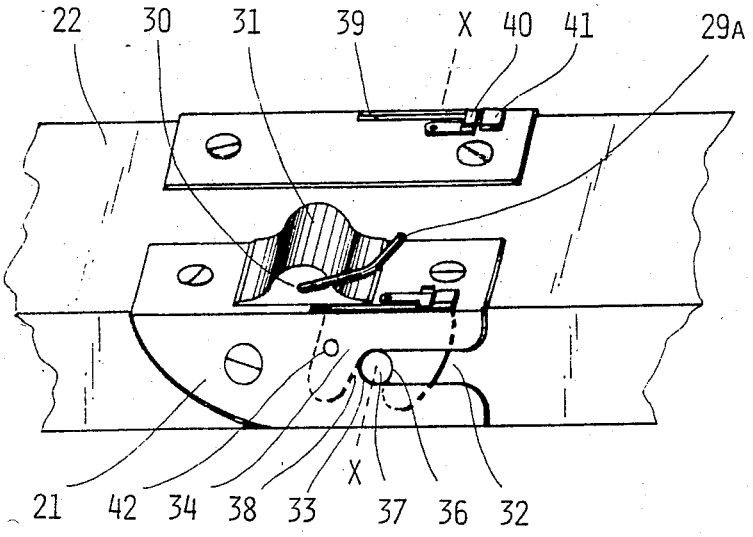
FIG. 2 is a perspective view of the preferred embodiment of the fastening elements showing the fastening elements attached to a ski, and also showing the preferred spring arrangement for biasing the braking element down in working position.

The non-slipping device according to FIGS. 1 and 2 includes a braking element having a blade 23 with a more or less sharp braking edge 24 and a preferably beveled front edge 25. The sides 26 of said braking element are turned up about perpendicularly to said blade 23 and include short pivot elements 27 adapted to co-act with fastening elements 21 attached to the ski 22, so that a pivot axis for the brake is formed at line X—X in the drawings. The braking element further includes restricting means 28 arranged to restrict the movement of the braking element relative to the ski. Restricting means 28 are preferably connected to spring means biasing said braking element to a deployed position about perpendicularly to the direction of the ski. One embodiment of such a spring is shown at 29 in FIG. 1, while the preferred embodiment of said spring means as shown in FIG. 2 contains a pivot pin 30 rotatably spring-mounted into a protecting fastening 31 attached to the ski 22. Said preferred spring means further includes pin 29*a* arranged to rotatably bias said restricting means 28 attached to the sides 26 of the braking element. The device may be provided with one spring only or with two springs, one for each of restricting means 28.

Fastening elements 21 are preferably evenly beveled in their edges and include slots 32 which are open in one direction and are sized to receive pivot elements 27 of the braking element, so that said pivot elements 27 with the braking element can be slid into the bottom 33 of said slots 32. The bottom 33 is preferably rounded so that pivot elements 27 fit snugly into the recess. The preferred embodiment of the invention includes a locking element 34 formed as a plate having therein slot 35, one side 36 of which is sized so as to form together with bottom 33 of slot 32 a retaining bearing 37 for the pivot elements. The opposite side 38 of slot 35 in the locking plate 34 is formed to assist in the retaining of pivot element 27 in bearing 37 by aligning with bottom 33 of slot 32 in the locking position as shown in FIG. 2. Side 38 of slot 35 is suitably, but not necessarily, formed in such a way that it assists in pushing out pivot means 27 from the bottom 33 of slots 32 when the braking element is being removed from the fastening elements.

According to the embodiment shown in FIGS. 1 and 2 locking plate 34 preferably is mounted inside of the outer side surface of fastening element 21 and is pivotally hinged to move in and out through a slot 39 in said fastening element 21. In this embodiment the locking plate is protected from snow and outer forces and thus ensures the undisturbed function on one hand of shutting to lock pivots 27 in place, and on the other hand opening to receive pivots 27 when the braking element is being slid into the fastening elements, or to allow for the removal of pivots 27 when the braking element is being loosened from the ski. Locking plate 34 is preferably kept in its shut position by an arresting element 40, which can have a spring function. In order to facilitate the lifting of locking plate 34 for the removal of the braking element the upper end of locking plate 34 is preferably provided with an ear 41. In the preferred embodiment locking plate 34 is opened when the arresting element has been loosened by lifting from ears 41 so that the pivotally hinged locking plate is swung around its axis 42 positioned outside the areas formed by slot 32 and slot 35. When locking plate 34 is lifted slot 35 moves about pivot 27 until the retaining side 36 of slot 35 lies completely above slot 32 of the fastening element 21, whereafter the braking element with pivots 27 can be pulled backwards and be freed.

Figure 5:
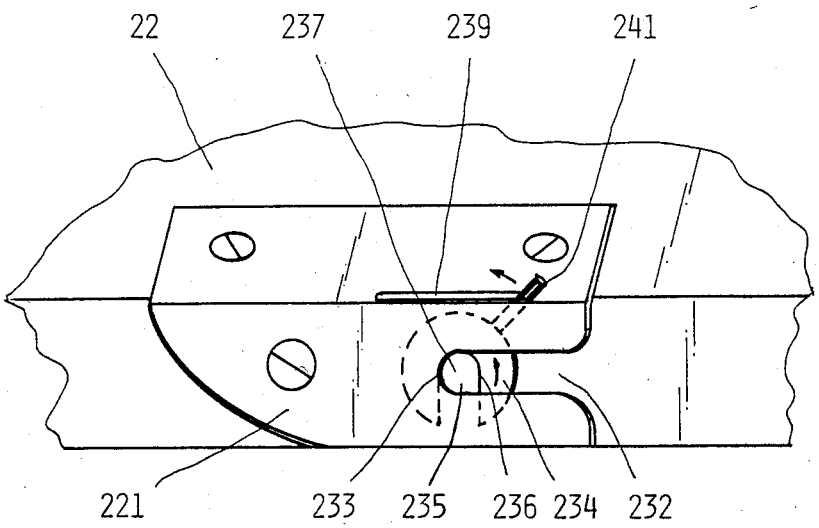
FIG. 5 shows an embodiment of the invention, wherein the lock plate is movable around the same axis as the pivoting axis of the braking element.

FIG. 5 shows another embodiment of the invention, wherein the pivot axis of locking plate 234 coincides with pivot axis X—X of the blade element. In this case slot 235 will coincidence with slit 232 of fastening element 221 when locking plate 234 is turned to open position by moving pin 241 to open position in slot 239 of fastening element 221. In still another possible embodiment the locking element with the retaining edge will not be turned around any axis at all, but will be linearily pushed in a position that will free the passage for pins 27 through the slot in the fastening element. This linear movement can in such an embodiment be exerted upwards in the plane of the sides of the ski, or penpendicular to this plane, i.e. into the ski.

Since the locking plates 34 in the preferred embodiment rest completely inside the outer side surfaces of the fastening elements 21, these side surfaces are quite even. The outer side surfaces of the braking element should likewise be even and suitably beveled. Both the braking element and the fastening elements 21 of the invention may be made of fairly thin material, and thus add very little to the width of the ski 22, which constitutes an important advantage of the construction, especially for skiing in narrow tracks. The inner surface of the fastening elements or alternatively the side surface of the ski should be provided with a suitable flat groove to allow for the movement of locking plate 34.

In the embodiment of FIGS. 1 and 2 slots 32 in fastening elements 21 are elongated backwards counted from the forward running direction of the skis and are open at the back. The stopping sides 36 of locking plates 34 are arranged to stretch behind pivots 27 in slots 32 when in locking position and to extend in an angle of about 45° to 135°, preferably in a more or less right angle, relative to the longitudinal direction of slots 32 and the skis 22.

Figure 3:
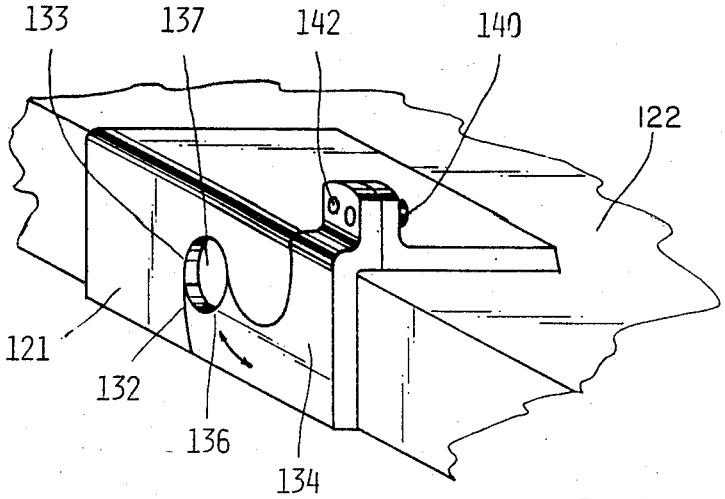
FIG. 3 is a perspective view of another embodiment of the invention, wherein the locking means comprise tongue shaped lock pieces formed integrally with the fastening elements.
Figure 4:
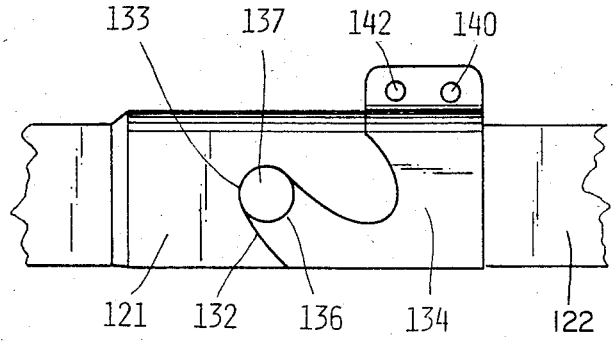
FIG. 4 is a plan view of the subject matter shown in FIG. 3.

FIGS. 3 and 4 show another embodiment of the fastening elements of the invention. In this embodiment the locking element is formed integrally with the fastening element 121 as a tongue shaped lock piece 134 pivotally mounted on pivot 142. The slot 132 of fastening element 121 is open at the back and shaped so as to form together with the front edge 136 of lock piece 134 a retaining bearing adapted to snugly receive the pivots of the braking element. When the braking element is mounted onto the skis 122 faucets 140 keeping lock pieces 134 in closed position are loosened and tongue shaped lock piece 134 is swung back to leave slot 132 open. The pivots 27 of the braking element are then slid into their position in slots 132 and the lock pieces are swung down to push pivot pins 27 snugly into bottom 133 of slots 132. Front edge 136 then surround the back of the pivots to form retaining bearings for said pivot pins, in which position lock pieces 134 are locked in position by faucets 140. Faucets 140 are preferably attached to fastening elements 121 in such a way that they can be moved but not removed. In other respects the function of the non-slipping device itself with its spring biased braking element including blade 23, side pieces 26, pivots 27, restricting means 28, and springs 29 or **29*a***, is similar to the braking element of the preferred embodiment.

The braking elements of the present invention may either by prefabricated to suit a standard width of skis or they may alteratively be adjustable to suit any width of skis.

FIGS. **6*a*, 6*b* and 6*c*** show different embodiments of how the blade may be adjusted to suit skis of different width.

FIGS. **6*a* and 6*b* show a blade having flanges 144 attached to the side pieces 126 of the braking element, said flanges 144 being adapted to receive an intermediate blade piece 123. To adjust the width of the blade intermediate blade piece 123 is cut to the right length and connected to flanges 144** in a permanent or semipermanent way by gluing, welding, screwing or the like.

Figure 6A:
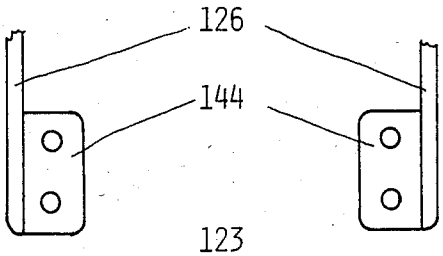
FIG. 6*a* is a plan view of the baking element and blade holding flanges with portions broken away.
Figure 6B:
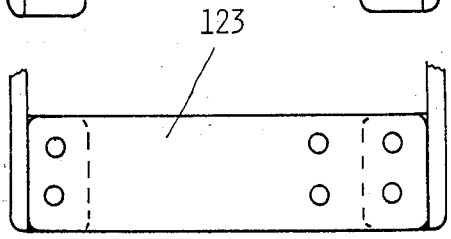
FIG. 6*b* is a view like FIG. 6*a* with the blade attached to the flanges.
Figure 6C:
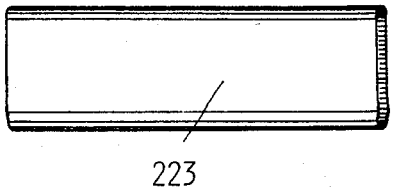
FIG. 6*c* is a view of an embodiment of the blade formed as a hollow sleeve adaptable to the flanges of FIG. 6*a*.

FIG. **6*c* illustrates another type of intermediate blade piece which is formed as a hollow sleeve 223 adapted to be threaded onto flanges 144 similar to the ones shown in FIG. 6*a***.

The dimensions of flanges 144 and intermediate blade pieces 123, 223 of FIGS. **6*a*, 6*b* and 6*c*** can be greatly varied to suit almost any width of skis.

I claim:

1. A non-slipping device for preventing the backward slipping of skis comprising:

(a) a fastening element attachable to the ski and extending at least down the vertical sides of the ski, at least a portion of said element being spaced apart from the vertical sides to define a narrow gap therebetween, and said element having on each of said sides a slot therein located below the top surface of the ski to provide access to said gap;

(b) a removable pivoting braking element including a braking blade under the bottom of the ski and a pair of side pieces extending on either side of the ski generally parallel to each other and orthogonal to said braking blade, each of said side pieces including a short pivot pin fixed thereto, said pivot pins extending towards each other and having a relative distance adjusted to about the width of the ski and sized to fit snugly into the bottom of said slots in said fastening element for pivotally connected said braking element to said fastening element;

(c) spring means attached to said ski applying a rotational force upon said side pieces of said braking element to cause said blade to be biased downwards substantially perpendicularly to the forward travel of the ski; and (d) locking means attached to said fastening element at a point adjacent said vertical side for locking said pivot pins in the bottom of said slot in said fastening element, and each of said locking means having a slot, said locking means sized to be substantially recessed within said gap when closed to form together with said slots in said fastening element retaining bearings for said pivot pins.

2. A non-slipping device according to claim 1 wherein the outer side surface of said locking means extend at the most as far out as the outer side surface of said fastening element.

3. A non-slipping device according to claim 2 wherein said locking means pivots about an axis parallel to the pivoting axis of said braking element.

4. A non-slipping device according to claim 3 wherein said side of said locking means urges said pivot pins snugly into said bottom of said slots in said fastening elements.

5. A non-slipping device according to claim 2 wherein the outer side surface of said locking means extends substantially between the outer side surface of said ski and the inner side surface of said fastening element, and wherein said locking means in locking position rest inside said fastening element.

6. A non-slipping device according to claim 1 wherein said fastening element includes two separate pieces, one for each side of the ski, each being independently fastenable to the ski.

7. A device according to claim 6 wherein said braking element includes a pair of flanges and a hollow intermediate blade sized to receive said flanges and extend therebetween, so that the blades of varying widths may be made by varying the length of the intermediate blade.

8. A non-slipping device for preventing the backward slipping of skis comprising:

(a) a fastening element attachable to the ski and extending at least down the sides of the ski and having on each of said sides a slot therein located below the top surface of the ski, said fastening element including two separate pieces, one for each side of the ski and being independently fastenable thereto;

(b) a removable pivoting braking element including a braking blade under the bottom of the ski and a pair of side pieces extending on either side of the ski generally parallel to each other and orthogonal to said braking blade, each of said side pieces including a short pivot pin fixed thereto, said pivot pins extending towards each other and having a relative distance adjusted to about the width of the ski and sized to fit snugly into the bottom of said slots in said fastening element for pivotally connecting said braking element to said fastening; and wherein said braking element includes a pair of flanges attached to said side pieces and a hollow intermediate blade sized to receive said flanges and to extend therebetween, so that blade of varying widths can be made by adjusting the length of the intermediate blade;

(c) spring means attached to said ski applying a rotational force upon said side pieces of said braking element to cause said blade to be biased downwards substantially perpendicularly to the forward travel of the ski, and locking means attached to said fastening element for locking said pivot pins in the bottom of said slot in said fastening element, and each of said locking means including a side thereof sized to form together with said slots in said fastening element retaining bearings for said pivot pins.

* * * * *